US006374913B1

(12) United States Patent
Robbins et al.

(10) Patent No.: US 6,374,913 B1
(45) Date of Patent: Apr. 23, 2002

(54) SENSOR ARRAY SUITABLE FOR LONG TERM PLACEMENT INSIDE WELLBORE CASING

(75) Inventors: Carl A. Robbins, Tomball; Bill Schaecher; Patrick D. Chesnutt, both of Houston, all of TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/572,510

(22) Filed: May 18, 2000

(51) Int. Cl.[7] ..... E21B 49/00
(52) U.S. Cl. ..... 166/66; 166/113; 702/6
(58) Field of Search ..... 166/250.01, 254.2, 166/66, 67, 113; 702/6

(56) References Cited

U.S. PATENT DOCUMENTS

| | | | | |
|---|---|---|---|---|
| 3,990,036 A | | 11/1976 | Savit | 340/15.5 |
| 4,986,350 A | | 1/1991 | Czernichow | 166/65.1 |
| 5,181,565 A | | 1/1993 | Czernichow | 166/66 |
| 5,243,562 A | | 9/1993 | Laurent et al. | 367/25 |
| 5,461,594 A | | 10/1995 | Mougenot et al. | 367/48 |
| 5,597,042 A | | 1/1997 | Tubel | 166/250.01 |
| 5,662,165 A | | 9/1997 | Tubel et al. | 166/250.01 |
| 5,724,311 A | | 3/1998 | Laurent et al. | 367/57 |
| 5,829,520 A | | 11/1998 | Johnson | 166/250.01 |
| 5,838,727 A | | 11/1998 | Lyon et al. | 375/261 |
| 5,886,255 A | * | 3/1999 | Aronstam | 166/254.1 |
| 5,926,437 A | | 7/1999 | Ortiz | 367/35 |
| 5,947,199 A | | 9/1999 | Havig | 166/250.01 |
| 5,978,317 A | | 11/1999 | Whitener | 367/178 |
| 5,979,588 A | | 11/1999 | Havig | 181/102 |
| 6,131,658 A | * | 10/2000 | Minear | 166/250.01 |
| 6,205,408 B1 | * | 3/2001 | Jubin et al. | 702/182 |
| 6,248,663 B1 | * | 6/2001 | Bixler et al. | 438/638 |

* cited by examiner

*Primary Examiner*—William Neuder
(74) *Attorney, Agent, or Firm*—Conley, Rose & Tayon, P.C.

(57) ABSTRACT

A system based on a series of data accumulation hubs, connected together by high speed communication backbone for routing a limited number of data and power cables is suggested. Each hub is connected to arrays of sensor pods which contain the actual sensor elements and minimal, if any, interface electronics. Preferably, as many as 20 sensor pods can be connected to each single hub element wherein a system including five hub elements with 20 sensor pods each would comprise a 100 element array. The data from the individual sensors are accumulated in the hubs, buffered, and conditioned for transmission to the surface data acquisition system through the high speed metal backbone comprising multiple paths of transmission for redundancy in the event of failure. Provisions are made within each of the hubs so that if a hydrostatic leak were to occur, the fault can be isolated and the remainder of the system will function as designed. A power delivery network is also preferably encased within the backbone along with the high speed data link.

8 Claims, 2 Drawing Sheets

SENSOR ARRAY SUITABLE FOR LONG TERM PLACEMENT INSIDE WELLBORE CASING

BACKGROUND OF THE INVENTION

1. Field of the Invention

This invention generally relates to a method and an apparatus for detecting and monitoring various conditions (e.g. seismic, pressure, and temperature signals) in and around a borehole. More particularly, the invention relates to a sensor array suitable for long-term placement inside a well, thereby permitting diverse measurements concerning the state of the well, flows inside the well, and the evolution of the reservoir over time.

2. Description of the Related Art

During the production of hydrocarbons from an underground reservoir or formation, it is important to determine the development and behavior of the reservoir and to foresee changes which will affect the reservoir. Various methods for determining and measuring downhole parameters for forecasting the behavior of the reservoir are well known in the art.

One method includes placing one or more sensors downhole adjacent the reservoir and recording seismic signals generated from a source often located at the surface. Hydrophones, geophones, and accelerometers are three typical types of sensors used for recording such seismic signals. Hydrophones respond to pressure changes in a fluid excited by seismic waves, and consequently must be in contact with the fluid to function. Hydrophones are non-directional and respond only to the compressional component of the seismic wave. They can be used to indirectly measure the shear wave component of a seismic wave when the shear component is converted to a compressional wave (e.g. at formation interfaces or at the wellbore-formation interface). Geophones measure both compressional and shear waves directly They include particle velocity detectors and typically provide three-component velocity measurement. Accelerometers also measure both compression and shear waves directly, but instead of detecting particle velocities, accelerometers detect accelerations, and hence have increased sensitivity at higher frequencies. Accelerometers are presently available with three-axis acceleration measurements. Both geophones and accelerometers can be used to determine the direction of arrival of the seismic wave. Any of the above devices or a combination thereof can be used to measure seismic signals within a borehole. Additional sensors that may prove beneficial to reservoir engineers include, but are not limited to, temperature sensors, pressure transducers, and position monitors (gyroscopes). Any or all of these sensors may be deployed concurrently with seismic sensors to help the engineer determine reservoir status.

In the past, wireline tools have been used to deploy well logging or vertical seismic sensors to profile reservoirs from within the bore of a well. Wireline sondes can contain a large assortment of sensors enabling various parameters to be measured, including acoustic noise, natural radioactivity, temperature, pressure, etc. The sensors may be positioned inside the production tubing for carrying out localized measurements of the nearby annulus or for monitoring fluid flowing through the production tubing. Although effective, wireline sondes are not considered a long term solution. Often a more permanent method for equipping wells with sensors is desired. Permanent sensor installations grant the reservoir engineer the ability to record time-lapse measurements over periods spanning days, months, and years. Such time-deferred measurements allow reservoir operators a more detailed picture of the amount of reserves remaining and the rate at which they are diminishing.

Additionally, many sensors, including accelerometers and geophones, must be mechanically coupled to the well formation in order to be effective. While wireline sensors of this type are currently in existence, they are often bulky and require special actuators to couple the sensor to the casing or formation wall and are not considered permanent. Permanent sensor arrays also provide the reservoir engineer with the ability to record measurements over a broader region and for longer periods of time.

Most of the cost of a typical seismic survey lies within the data acquisition methods currently performed upon temporary arrays of surface sources and receivers. Long-term emplacement of the receivers has the potential of significantly lowering data acquisition and deployment costs. There are two major benefits of long-term emplacement of sensors, first, repeatability is improved, and second, by positioning the receivers closer to the reservoir, noise is reduced and vertical resolution of the seismic information is improved. Further, from an operational standpoint, it is preferred that receivers be placed in the field early to provide the capability of repeating 3-D seismic surveys at time intervals more dependent on reservoir management requirements than on data acquisition constraints. By obtaining a sequence of records distributed over a long period of time, it becomes possible to monitor the movement of fluid in the reservoirs, and to thereby obtain information needed to improve the volume of recovered hydrocarbons and the efficiency with which they are recovered. For whatever the reason long-term emplacement is desired, it is of utmost importance that emplaced sensors move as little as possible throughout their lifetime. Movement in long-term sensors can disrupt the credibility of data collected over long periods of time.

A "permanent" method that has been previously used involves the attaching of sensors to the exterior of the well casing as it is installed. Following installation, the annulus around the casing is then cemented such that when the cement sets, the sensors are permanently and mechanically coupled to the casing and formation. One major drawback to a system of this type, is that there is considerable chance for a failure during the installation process, a failure that will, for the most part, not be detectable until after the cementing process is complete. If a system becomes inoperable following cementing, it becomes prohibitively expensive and difficult to repair the system and it is left in place, in an inoperable condition. Another limitation of this system is that it must be installed during the well construction process, before completion. Such a system can not be added to a well at a later date if desired.

An apparatus for a permanent sensor array has been presented in U.S. patent application Ser. No. 09/260,746 Method for Permanent Emplacement of Sensors Inside Casing filed Mar. 1, 1999 by John W. Minear hereby incorporated herein by reference. Minear presents a system whereby an array of permanent sensor devices are installed within well casing by having them mounted about the outer profile of a string of coiled tubing installed therein. In one instance, the sensors of Minear are mounted upon spring loaded carriers that are compressed during installation and held into place following installation by the stored energy of the springs loaded carriers. This arrangement allows for the sensors to be mechanically coupled to the casing, with little chance of positional changes over long periods of time. The main advantage that such a system provides is the ability to have a permanent sensor array that can be retrieved in the event of a system failure. Minear also provides a solution whereby the sensors of the array are connected to one another and the surface by a durable and flexible cable. The cable of Minear is as durable and crush resistant as metal conduit, but flexible to allow effective emplacement of sensors against the casing wall.

The only potential drawback to the system as proposed by Minear is that there may be a significant risk of damage to the sensor pods during array installation. As sensors are engaged through the casing, they are held against the casing wall by the spring loaded carriers and are essentially "dragged" to their final destination. During such an operation, it is possible that one or more of the sensor devices will become damaged and inoperative. Unless expensive fault isolators are installed in conjunction with each sensor, a damaged sensor on a typical array can require the retrieval of the entire system for repairs.

Even after installation is successfully completed, there remains a chance for failures to occur in the many months following the original installation. If the entire sensor array must be removed from the wellbore for repairs, long term data analysis can no longer be performed with precision as the position of each sensor will have changed relative to the formation, making most extended time lapsed "before" and "after" data comparisons invalid. For this reason, an arrangement and method that ensures the effective operation of a "permanent" sensor array for many years following installation is of utmost importance to reservoir engineers.

A reliable permanent sensor array system has long been identified as highly desirable by reservoir engineers. The system could be compatible with a variety of existing standard surface seismic sources in order to provide high quality seismic measurements. By emplacing the sensors permanently in the well, the variances that result from repositioning the sensors between repeat surveys of a long term monitoring project can be eliminated. The sensor array must be reliable as it may need to be in place for as many as 10 years to provide the necessary surveys and must be capable of surviving hostile environments, including elevated temperatures, pressures, and corrosive wellbore fluids. Finally, the permanent sensor array must be economical to produce and deploy.

Current means of communication with the surface for sensor arrays are either digital or analog. Analog communication typically requires a twisted pair of wires to be run to the surface for each of the deployed sensors. For arrays with large amounts of sensors, this communication can require a very large umbilical cable to be run from the surface to the sensors. For example, an array of 100 sensor pods containing 3 accelerometers (one for each axis) would require a 600 wire umbilical cable. For most installations, this is too large to be feasible. Additionally, the accuracy of deployed sensors in such a system can be reduced as a result of cable attenuation and crosstalk effects. Environmental tolerance is also generally poor due to variation in the cable characteristics after prolonged exposure to elevated temperature and pressure.

Alternatively, a digital communication system can be deployed in place of the analog communication system to offer a dramatic reduction in required cable size. For the example above, a comparable digital array of sensors could be arranged such that all 100 pods and all 300 sensors could communicate to the surface with one wire or a fiber optic line. A major drawback of the digital method described above is that failure of one sensor pod can destroy the entire communication link to all others.

The present invention overcomes these deficiencies of the prior art.

BRIEF SUMMARY OF THE INVENTION

The deficiencies of the prior art can be resolved using a system that is based on a series of data accumulation hubs, connected together by high speed communication backbone for routing data and power signals. Each hub is then connected to an individual array of sensor pods which contain the actual sensor elements and minimal interface electronics. Upper and lower strings of sensor pods are connected to each hub by flexible elastomeric cable to ease the emplacement of the sensors against the casing.

BRIEF DESCRIPTION OF THE DRAWINGS

For a detailed description of a preferred embodiment of the invention, reference will now be made to the accompanying drawings wherein.

Figure 1:
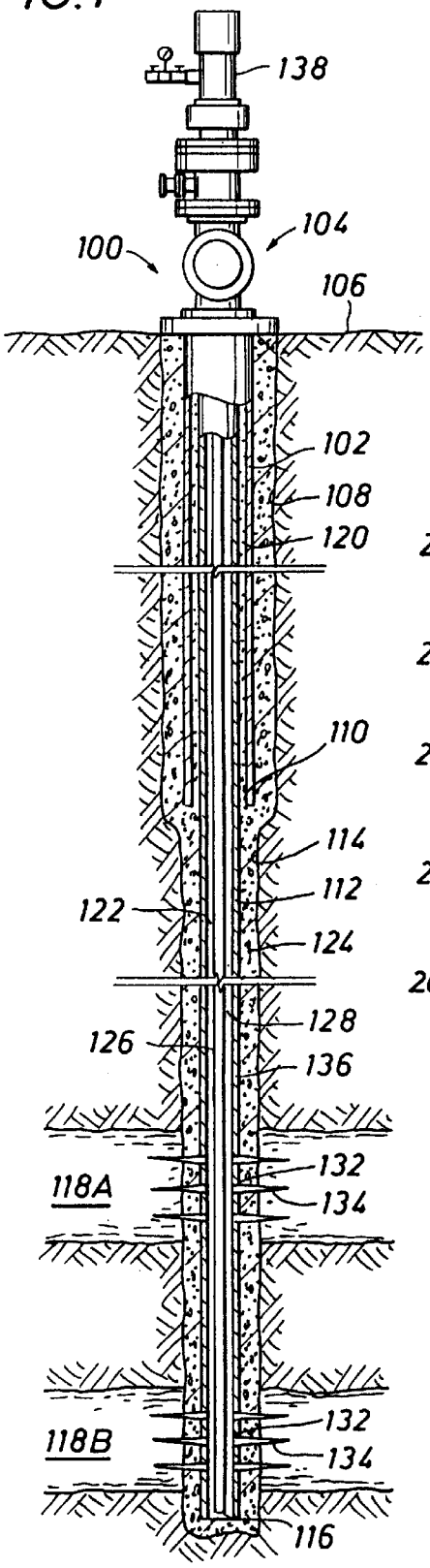
FIG. 1 is a simplified schematic of a well.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Referring initially to FIG. 1, there is shown a simplified depiction of a well 100. Well 100 has an outer casing 102 extending from a wellhead 104 at the surface 106 through a large diameter borehole 108 to a certain depth 110. Outer casing 102 is cemented within borehole 108. An inner casing 112 is supported at wellhead 104 and extends through outer casing 102 and a smaller diameter borehole 114 to the bottom 116 of the well 100. Inner casing 112 passes through one or more production zones 118A, 118B. Inner casing 112 forms an annulus 120 with outer casing 102 and an annulus 122 with borehole 114. Annulus 120 and annulus 122 are filled with cement 124. A production tubing string 126 is then supported at wellhead 104 and extends down the bore 128 of inner casing 112. The hydrocarbons from the lowest production zone 118B flow up the flow bore 136 of production tubing 126 to the wellhead 104 at the surface 106, while the hydrocarbons from the other production zone 118A may be comingled with the flow from zone 118B or may flow up the annulus between inner casing 112 and tubing 126. A christmas tree 138 is disposed on wellhead 104 and is fitted with valves to control flow through tubing 126 and the annulus around tubing 126.

Figure 2:
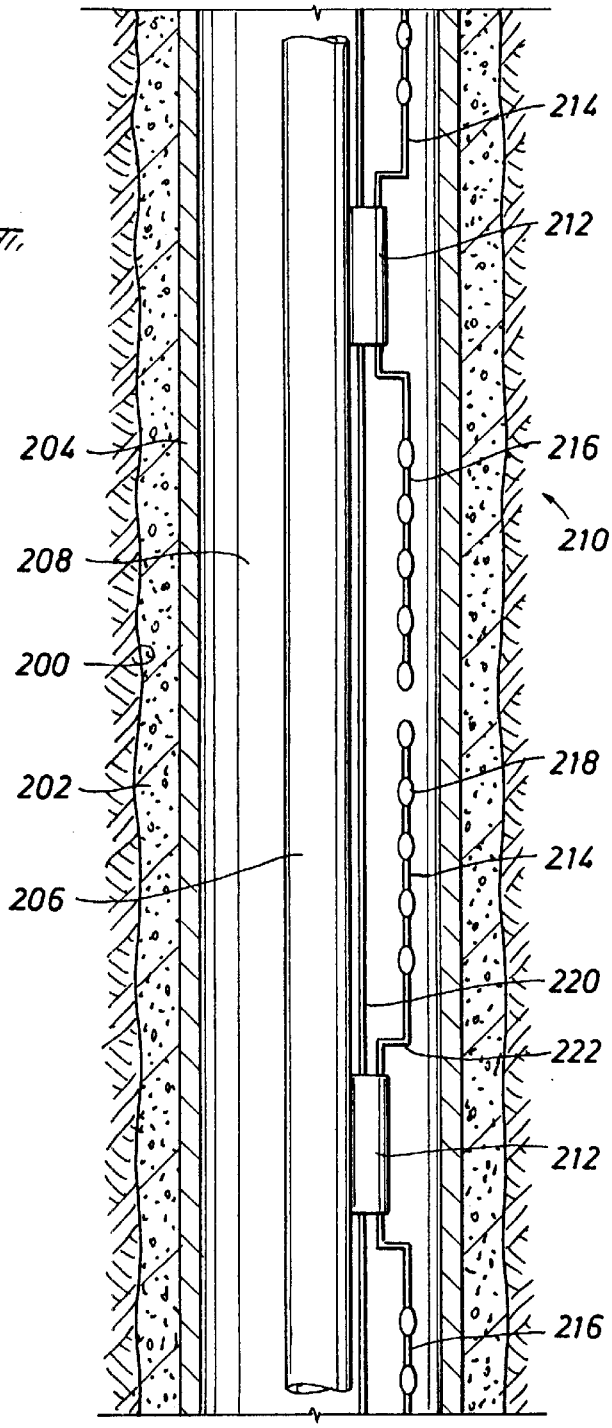
FIG. 2 is a close up view of a length of production tubing showing a schematic representation of a permanent sensor array in accordance with a preferred embodiment of the present invention.

Referring now to FIG. 2, a drawing of a wellbore including a schematic drawing of a permanent downhole sensor array system is shown. Wellbore 200 is drilled within a formation 202 and includes a casing 204 and a tubing string 206 engaged within to form an annulus 208. Mounted about tubing string 206 is a permanent sensor array 210. Sensor array 210 shown in FIG. 2 comprises a network of data hubs 212, each with an upper branch 214 and a lower branch 216 of sensor pods 218 mounted upon data cables 222. A conduit 220 connects hubs 212 together and contains communication and power distribution wires.

Sensor array 210 is preferably deployed by attaching it about the outer profile of tubing string 206 while it is engaged within casing 204. Array 210 is positioned upon tubing string 206 such that sensor pods 218 will correspond to desired points of investigation once tubing 206 is fully deployed within wellbore 200. Sensor array 210 is based on a system of electronic hubs 212 that are connected to each other and to the surface by means of conduit 220. Conduit 220 is preferably a rigid metal tubular structure and preferably houses both a high speed communications network and a power distribution backbone.

Preferably, hubs 212 contain all or most electronic devices necessary for the array to communicate with and distribute power from the surface equipment. By locating all electronic communication and power devices for array 210 within hubs 212, the complexity, size, weight, and expense of sensor pods 218 can be minimized. To maintain reliability, hubs 212 may be properly sealed to prevent drilling fluid leakage and be manufactured of a durable material that is capable of surviving the extreme wear, heat and impact situations that are commonly experienced in downhole environments, In the preferred embodiment, hubs 212 and conduit 220 are rigidly attached to the outer surfaces of tubing 206 by any one or more of an assortment of methods including but not limited to adhesives, straps, clamps or welds.

Connected to hubs 212 by means of a cable apparatus 222 are upper branches 214 and lower branches 216 of sensor pods 218. Sensor pods can contain any number or configuration of sensors to detect and report back well and reservoir conditions. Although no specific apparatus or method is required, it is preferred that pods 218 be held firmly in place by means of a spring loaded engagement device (not shown) to maintain secure contact between pods 218 and the surface of casing 204. Additionally, it is preferred that sensor pods 218 be mounted upon a cable assembly 222 that is flexible to facilitate their secure emplacement against casing 204 or formation 200. If cable apparatus 222 were inflexible, emplacement method would require an increased biasing capability in order to properly secure sensor pod 212 against wall of casing 204 or formation 202. Acceptable embodiments for cable assembly 222 and spring loaded engagement device are presented in the above referenced Minear application.

Sensor information is transmitted from pods 218 to the reservoir engineer at the surface by first routing it through data collection hubs 212. Communication between sensor pod 218 and hub 212 can either be digital or analog, and can be accomplished through metallic wires, optical fibers, or any other acceptable form of transmission. In a preferred embodiment, each sensor within a pod 218 communicates to its hub 212 though a twisted wire pair and utilizes analog communication. For example, a sensor pod containing three accelerometers (one for each axis of investigation) will have a total of 6 wires communicating with its hub. For a sensor array 210 wherein each branch 214 or 216 contains 5 sensor pods, as many as 30 wires may need to be contained within each cable assembly 222. Analog communication is preferred for this communication link because it does not require any additional electronics to be located within sensor pods 218. Because the length and number of wires within each cable assembly 222 is relatively small, the signal loss and required cable diameter is low enough to allow communication between sensor pods 218 and hub 212 at a level of reliability and quality not commonly associated with downhole analog signals.

In contrast, digital communication is preferred for the link from hub 212 to the surface because of its reliability over long lengths and potential for high speed data transmission. Each hub 212 receives data from sensor pods 218 of upper 214 and lower 216 branches and encodes the data for communication with the surface. Additionally, hubs 212 may also include sensors that are not contained in sensor pods 218. The types of sensors that are located within data hubs 212 typically either require complex electronics to operate, do not need frequent measurements, or are too expensive to place in every sensor pod 218. Once data is collected in hubs 212, it is sent to the surface by a high speed communication link contained within conduit 220 where reservoir engineers are able to extrapolate information that they need.

Additionally, it is preferred, but not required, that every hub 212 have a fault isolator installed so that in the event of a failure of a hub 212, the remaining hubs on the circuit are not disabled. An example of such a fault isolator is a pressure fuse that, when crushed, electrically isolates the network 220 from the hub 212, thereby preventing a failure of the hub from shorting out the network while preserving the connection to all the other remaining hubs. Because fault isolators of this type are expensive, it was not practical before to place them in conjunction with every sensor of prior art designs, but in conjunction with the hub design, they are more economically feasible.

Figure 3:
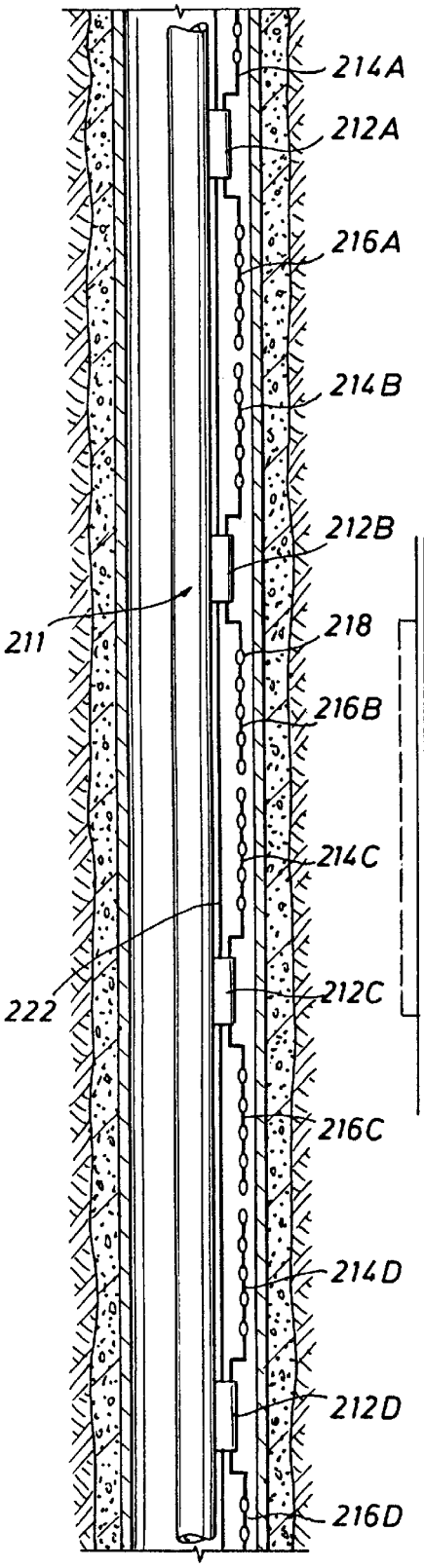
FIG. 3 is a zoomed out view of the sensor array of FIG. 2 to schematically show grouping schemes.

FIG. 3 demonstrates an arrangement for a sensor array 211 in accordance with a preferred embodiment of the present invention. In this figure, four hubs, 212A, 212B, 212C, and 212D, are shown. Each hub contains a corresponding upper branch 214A, 214B, 214C, and 214D, of sensor pods 218, and a corresponding lower branch, 216A, 216B, 216C, and 216D. The letter designations, A, B, C, and D, refer to a grouping that corresponds to a pair of twisted wires (not shown) contained within conduit 220. The goal of array 211 is to increase system redundancy so that well resolution is reduced but not completely lost in the event of a component failure. Array 211 divides downhole sensors into four distinct communication systems but alternate grouping schemes can be used. For example in the four group arrangement, hubs 212B, 212C, and 212D and their corresponding sensor pods 218 will function as normal if the A transmission twisted wire pair becomes shorted or damaged, and vice versa. Only sensor pods 218 attached to upper 214A and lower 216A branches of hubs 212A that are serviced by communications line A are affected. Using this arrangement, only every fourth hub 212 in array 211 will be connected to a common twisted pair communications wire. This interleaving arrangement reduces the probability of losing all sensors in an entire section of the well. To minimize system cost and space requirements, all twisted wire pairs are preferably contained within a single conduit 220. Array 210 of long-term sensor pods 218, disposed on umbilical cable 220, is preferably disposed on production tubing 206 as tubing 206 is assembled and lowered into the bore of inner casing 204. Sensors 218 are preferably attached to the outside of the tubing 206 at specified depth intervals and may extend from the lower end of tubing 206 to the surface. A consideration in placing the arrays 210, 211 of sensors 218 is in protecting the sensors 218 and the telemetry path from damage during the emplacement operation. Umbilical cable 220 is preferably capable of withstanding both abrasion and crushing as the pipe is passed downwardly through the casing 204. It should be appreciated that although the array 210 is shown disposed upon tubing 206, array 210 may also be disposed on inner casing 204.

In an exemplary implementation, a monitoring well could have 10 sensors spaced about 50 feet apart in each branch, so that a given hub carries the sensor information for a 1000 ft segment of the well. Each backbone cable in conduit 220 may support up to 5 such hubs. If 4 backbone cables are provided in conduit 220, the hubs are preferably spaced 4000 ft apart, so that the 1000 ft segments for a given backbone cable are interleaved with those for other backbone cables.

Figure 4:
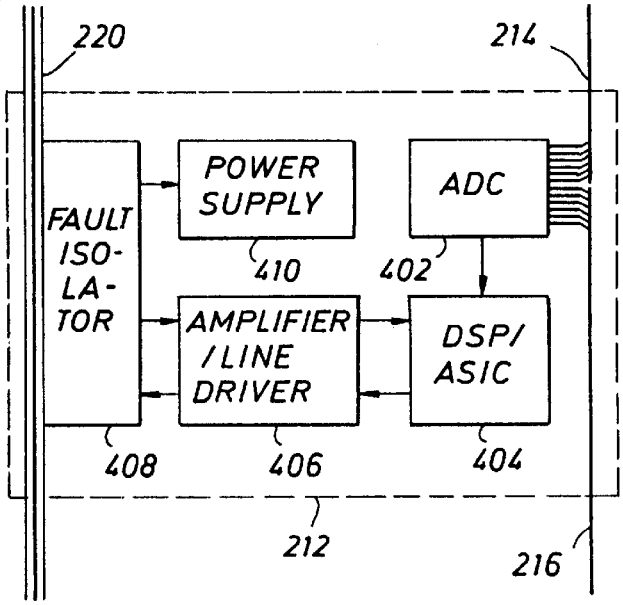
FIG. 4 is a block diagram of an exemplary hub embodiment.

FIG. 4 shows an exemplary embodiment of hub 212. An analog-to-digital converter (ADC) 402 couples to the sensors on upper branch 214 and lower branch 216 and digitally samples their analog signals. A digital signal processor (DSP) or application specific integrated circuit (ASIC) 404 takes the digital samples, applies filtering or processing if desired, then communicates them to the surface using standard digital communications techniques such as, e.g., scrambling, error correction coding, interleaving, amplitude/phase modulation, orthogonal signaling, and pulse shaping. The communications signal from the DSP 404 is preferably confined to a frequency band assigned to hub 212. This allows network 220 to employ frequency division multiplexing to concurrently carry communications signals from multiple hubs. Further, this allows power to be provided as a DC signal or a low-frequency signal over the network 220 without interfering with the hub communication signals. Still further, this allows the frequency range corresponding to a failed/failing hub to be filtered out at the surface, thereby avoiding impairment of communications with other hubs.

A line driver and amplifier block 406 is provided to buffer the signals to and from the DSP 404. This improves the signal to noise ratio of the signals by avoiding distortion effects from line loading. All the signals to and from the network 220 pass through a fault isolator 408, including a power signal to the power supply 410. The power supply 410 conditions and regulates power for the other hub components, and preferably also for the sensors on branches 214 and 216.

With multiple backbone cables in conduit 220, the disclosed architecture supports interleaved sensor coverage segments so that as hub failures occur, the system may advantageously experience a graceful degradation rather than complete failure. Further, the system advantageously supports the use of a few, hardened hubs that, because of the small number, can have expensive redundancy features incorporated into them. These hubs are shared by a larger number of inexpensive, lightweight sensors that individually cause an insignificant degradation if they fail. It is expected that the overall system will cost less for a given level of reliability and performance than competing systems.

Numerous variations and modifications will become apparent to those skilled in the art once the above disclosure is fully appreciated. For example, it is noted that the disclosed system could be employed on both coiled tubing and threaded tubing. It is intended that the following claims be interpreted to embrace all such variations and modifications.

What is claimed is:

1. An array disposed between inner and outer concentric pipes extending into a well from the surface comprising:

a plurality of data collection hubs;

a plurality of sensor groups, each having a plurality of sensor pods configured to perform downhole measurements;

a backbone extending from the surface of said well through each of said data collection hubs to allow said hubs to communicate with a surface controller;

said backbone also containing a distribution system to deliver electrical power from the surface of said well to each of said data collection hubs;

at least one of said sensor groups extending from each of said data collection hubs;

an umbilical cable to connect said sensor pods of each of said sensor group together; and said umbilical cable to allow communication between each of said data collection hubs and each of its said sensor groups, wherein said backbone comprises multiple communication paths, and wherein each of said communication paths communicates only with a partial set of said data collection hubs.

2. The array of claim 1 wherein members within each of said partial sets of data collection hubs are staggered along the length of said well so that no adjacent data collection hubs utilize a common communication path.

3. The array of claim 2 wherein said array functions properly but with diminished resolution as long as at least one of said communication paths remains intact.

4. An array disposed between inner and outer concentric pipes extending into a well from the surface comprising:

a plurality of data collection hubs;

a plurality of sensor groups, each having a plurality of sensor pods configured to perform downhole measurements;

a backbone extending from the surface of said well through each of said data collection hubs to allow said hubs to communicate with a surface controller;

said backbone also containing a distribution system to deliver electrical power from the surface of said well to each of said data collection hubs;

at least one of said sensor groups extending from each of said data collection hubs;

an umbilical cable to connect said sensor pods of each of said sensor group together; and said umbilical cable to allow communication between each of said data collection hubs and each of its said sensor groups, wherein said data collection hubs include measurement devices to report information to said surface controller not collected by said sensor pods.

5. An array disposed between inner and outer concentric pipes extending into a well from the surface comprising:

a plurality of data collection hubs;

a plurality of sensor groups, each having a plurality of sensor pods configured to perform downhole measurements;

a backbone extending from the surface of said well through each of said data collection hubs to allow said hubs to communicate with a surface controller;

said backbone also containing a distribution system to deliver electrical power from the surface of said well to each of said data collection hubs;

at least one of said sensor groups extending from each of said data collection hubs;

an umbilical cable to connect said sensor pods of each of said sensor group together; and said umbilical cable to allow communication between each of said data collection hubs and each of its said sensor groups, wherein each pair of adjacent data collection hubs include a fault isolator therebetween to prevent failure of one of said data collection hubs from causing failure of the remainder of said array.

6. An array disposed between inner and outer concentric pipes extending into a well from the surface comprising:

a plurality of data collection hubs connected together by a backbone extending from the surface to communicate with a surface controller;

an upper and a lower branch of sensor pods extending from each of said data collection hubs and each connected thereto by an umbilical conduit, wherein said upper branch and said lower branch extend in opposite directions along the concentric pipes;

said umbilical conduits to encase and protect all lines of communication extending from said sensor pods within said upper or said lower branches to said data collection hubs;

said backbone comprising digital communication lines to allow said hubs to communicate with said surface controllers at a high rate of speed.

7. The array of claim 6 wherein said backbone further comprises a network to distribute power from the surface to said data collection hubs.

8. The array of claim 7 wherein said power distribution network and said digital communication lines exist on a common wire pair.

* * * * *